US006430818B1

(12) United States Patent
Wonderley

(10) Patent No.: US 6,430,818 B1
(45) Date of Patent: Aug. 13, 2002

(54) SHAVING CARTRIDGE

(75) Inventor: Jeff Wonderley, Fort Defiance, VA (US)

(73) Assignee: American Safety Razor Company, Verona, VA (US)

( * ) Notice: Subject to any disclaimer, the term of this patent is extended or adjusted under 35 U.S.C. 154(b) by 228 days.

(21) Appl. No.: 09/059,699

(22) Filed: Apr. 14, 1998

Related U.S. Application Data

(60) Provisional application No. 60/073,956, filed on Feb. 6, 1998.

(51) Int. Cl.[7] ..... B26B 21/06; B26B 21/22; B26B 21/54

(52) U.S. Cl. ..... 30/346.57; 30/41; 30/50; 30/84

(58) Field of Search ..... 30/40, 41, 50, 30/51, 68, 84, 538, 346.5, 346.57, 41.5, 77

(56) References Cited

U.S. PATENT DOCUMENTS

| | | | | |
|---|---|---|---|---|
| 4,026,016 A | | 5/1977 | Nissen | |
| 4,063,354 A | | 12/1977 | Oldroyd et al. | |
| 4,170,821 A | | 10/1979 | Booth | |
| 4,270,268 A | | 6/1981 | Jacobson | |
| 4,378,634 A | | 4/1983 | Jacobson | |
| 4,442,598 A | | 4/1984 | Jacobson | |
| 4,535,537 A | * | 8/1985 | Ferraro et al. | 30/41 X |
| 4,562,644 A | * | 1/1986 | Hitchens | 30/41 |
| 4,883,779 A | | 11/1989 | McAllister et al. | |
| 5,359,774 A | * | 11/1994 | Althaus | 30/50 |
| 5,524,347 A | * | 6/1996 | Prochaska | 30/50 |
| 5,661,907 A | | 9/1997 | Apprille, Jr. | |
| 5,666,729 A | | 9/1997 | Ferraro | |
| 5,781,997 A | * | 7/1998 | Ferraro et al. | 30/50 |

* cited by examiner

*Primary Examiner*—Boyer Ashley
(74) *Attorney, Agent, or Firm*—McDermott, Will & Emery

(57) ABSTRACT

A blade cartridge including a platform member having a blade seat, and a guard member located forward of and parallel to the blade seat so as to form a longitudinal slot between the blade seat and the guard member. A first blade is disposed on the blade seat such that the cutting edge of the blade is located rearwardly of the guard member. A spacer is located on the upper surface of the first blade. The spacer includes an upper surface having a plurality of protruding members extending therefrom and extending through apertures on a second blade such that the second blade is disposed on the upper surface of the spacer. The first blade has apertures that allow debris to flow between the first and second blades and downward through the aperture in the first blade and out through the platform member. A third blade is disposed on an upper surface of the protruding members of the spacer, thereby forming a gap defined by the second and third blades. The blade cartridge also includes a cap member having staking pins extending downwardly therefrom which are used to permanently affix the blade seat, blades, spacer, and cap member together.

30 Claims, 6 Drawing Sheets

SHAVING CARTRIDGE

This application is based upon Provisional Patent Application Serial No. 60/073,956, entitled "Triple Blade Shaving Cartridge", filed on Feb. 6, 1998.

BACKGROUND OF THE INVENTION

The present invention relates to wet shaving systems of the blade type and more particularly to a shaving system having a spacer used to position a plurality of blades within a blade cartridge.

Shavers have long sought a smooth and close shave. In the quest to find the ultimate "close shave", a dual blade razor was developed that included a first blade that gave a rough cut, and a second blade that gave a closer cut. The dual blade razor configuration requires small razor blades mounted in close proximity to each other within a small blade cartridge. The small dual blade cartridge tends to collect shaving debris, such as hair and shaving cream, which prevents the blades from properly engaging and cutting hair. The shaver must continuously attempt to flush the shaving debris from within the cartridge,using water. While various blade cartridges have been developed for dual blade razors to diminish the clogging problem presented by the small dual blade cartridge, this problem still persists.

In the pursuit to develop the ideal shaving implement, razor blade cartridges have been developed that include three blades. The triple blade configuration allows for a closer shave than conventional dual blade configurations because three cutting edges are used rather than two cutting edges. However, the development of a triple blade cartridge presents even greater clogging problems than the dual blade cartridge presented.

Each individual blade in a blade cartridge must be securely fastened to the blade cartridge to prevent injuring the shaver. However, the razor blade cartridge must be developed having flow channels through the blade cartridge, which allow water to effectively flush the debris from the cartridge. The blade cartridge must be configured such that the structure used to secure the blades within the blade cartridge does not prevent the inclusion of flow channels or minimize the number and size of flow channels, thereby resulting in shaving debris clogging within the blade cartridge.

Additionally, the blade cartridge must be constructed with flow channels that are not obstructed by a handle mounted to the blade cartridge. U.S. Pat. No. 5,661,907, issued on Sep. 2, 1997, to Domenic Apprille, Jr. describes a razor blade assembly including three blades mounted within a housing. The patent to Apprille appears to describe a blade cartridge having flow channels with openings oriented on a portion of the housing that is used to connect a handle to the blade housing. This configuration may create a situation in which the handle prevents shaving debris from travelling through the flow channels and causes the blade cartridge to become clogged.

The blade cartridge must also give proper support for the blades in order to prevent injury to the person shaving. U.S. Pat. No. 5,666,729, issued on Sep. 16, 1997, to Frank A. Ferraro describes a shaving system having a first support, at least one resilient support and a plurality of blades arranged in a spaced relationship and supported by the resilient support. However, the resilient nature of the supports requires either that a large number of supports be used or large supports be used to securely mount the blades and prevent excessive movement of the blades within the cartridge that might injure the person shaving. The use of a large number of supports or the use of large supports will limit the size of the flow path through the blade cartridge and thereby make the blade cartridge less efficient in removing shaving debris from the blade cartridge.

While it has been noted that proper support for the blades is necessary in order to prevent injury to the user, it is desirable to provide. as much open space between the blades and through the blade cartridge as possible in order to facilitate the removal of shaving debris from the blade cartridge.

SUMMARY OF THE INVENTION

The present invention provides a novel blade cartridge constructed to satisfy the aforementioned needs. The invention embodies a plurality of blade members permanently fixed relative to the blade cartridge. Unlike the blade assemblies of the prior art, significant space is allowed between the various blades in the blade cartridge of the present invention. The second and third blades are mounted using a unique spacer such that a substantial amount of open space is left between the second and third blades. The open space allows shaving debris to be flushed from the blade cartridge by water either through the rear or the front of the cartridge.

Accordingly, the present invention relates to a blade cartridge including a platform member having a blade seat and a guard member. The guard member is located of forward and parallel to the blade seat so as to form a longitudinal slot between the blade seat and the guard member. A first blade is disposed on the blade seat such that the cutting edge of the blade is located rearwardly of the guard member. Preferably, the cutting edge of the first blade is parallel to the guard member.

The blade cartridge of the present invention also includes a spacer located on the upper surface of the first blade. The spacer includes an upper surface having a plurality of protruding members extending therefrom. The protruding members extend through apertures on a second blade such that the second blade is disposed on the upper surface of the spacer. The first blade has apertures that allow shaving debris to flow between the first and second blades and downward through the aperture in the first blade and out through the platform member. A third blade is disposed on an upper surface of the protruding members thereby forming a gap defined by the second and third blades.

The blade cartridge also includes a cap member disposed on an upper surface of the third blade. The cap member of the present invention preferably includes staking pins extending downwardly therefrom which are used to permanently affix the blade seat, blades, spacer, and cap member together.

The invention itself, together with further objects and advantages, will best be understood by reference to the following detailed description taken in conjunction with the accompanying drawings.

BRIEF DESCRIPTION OF THE DRAWINGS

FIGS. 1 though 11 are presented by way of illustration and not limitation to depict the preferred embodiments of the present invention. Embodiments including the various aspects of the present invention will now be described in detail with reference to the accompanying drawings.

DETAILED DESCRIPTION OF THE INVENTION

Figure 1:
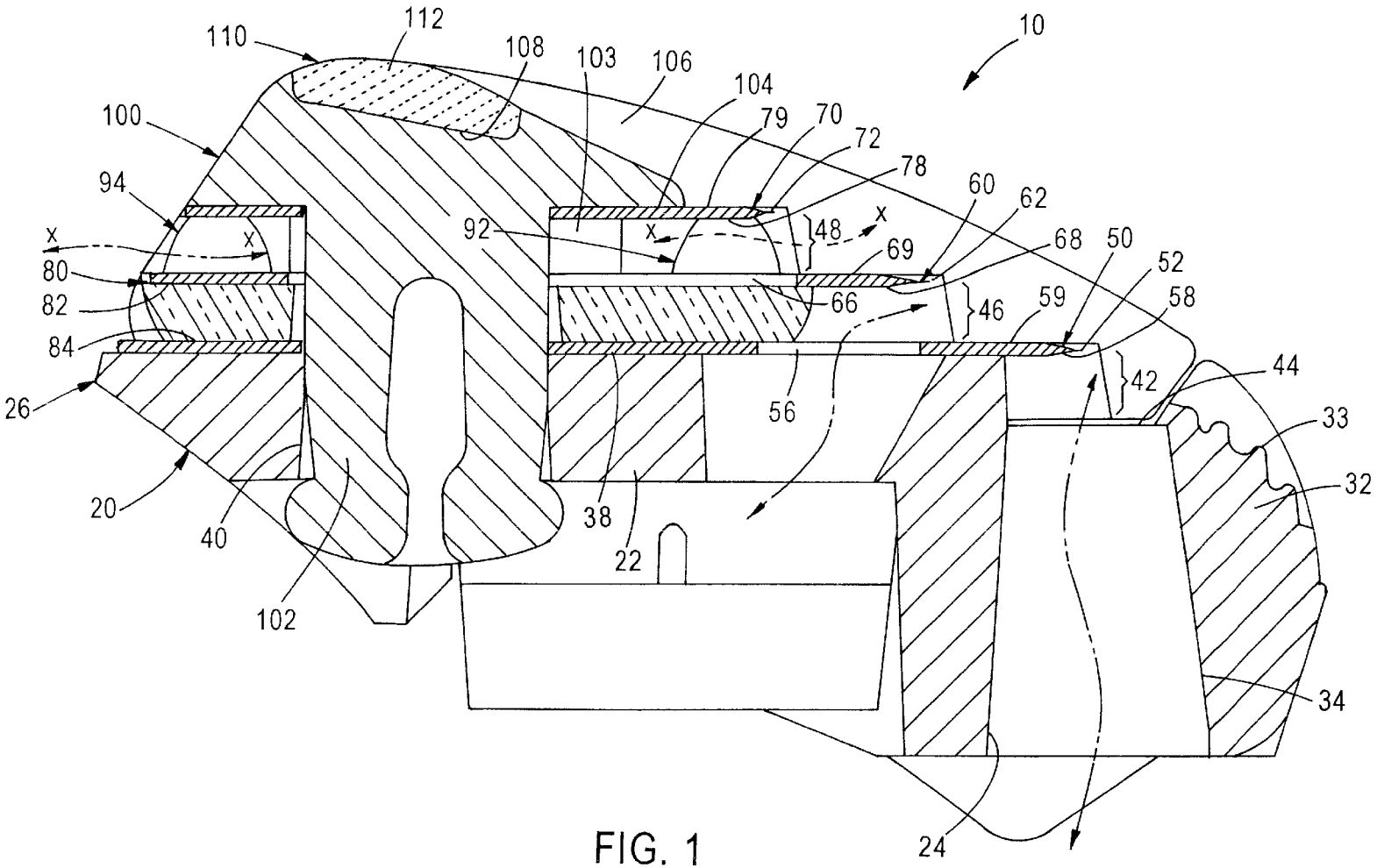
FIG. 1 is a cross-sectional view of a blade cartridge of the present invention through a rivet on the cap member illustrating the complete assembly.

FIGS. 1 through 11 illustrate a triple blade shaving cartridge (or blade cartridge or razor head) 10 which includes a platform member 20, a first blade 50, a second blade 60, a third blade 70, a spacer 80, and a cap member 100.

Figure 2:
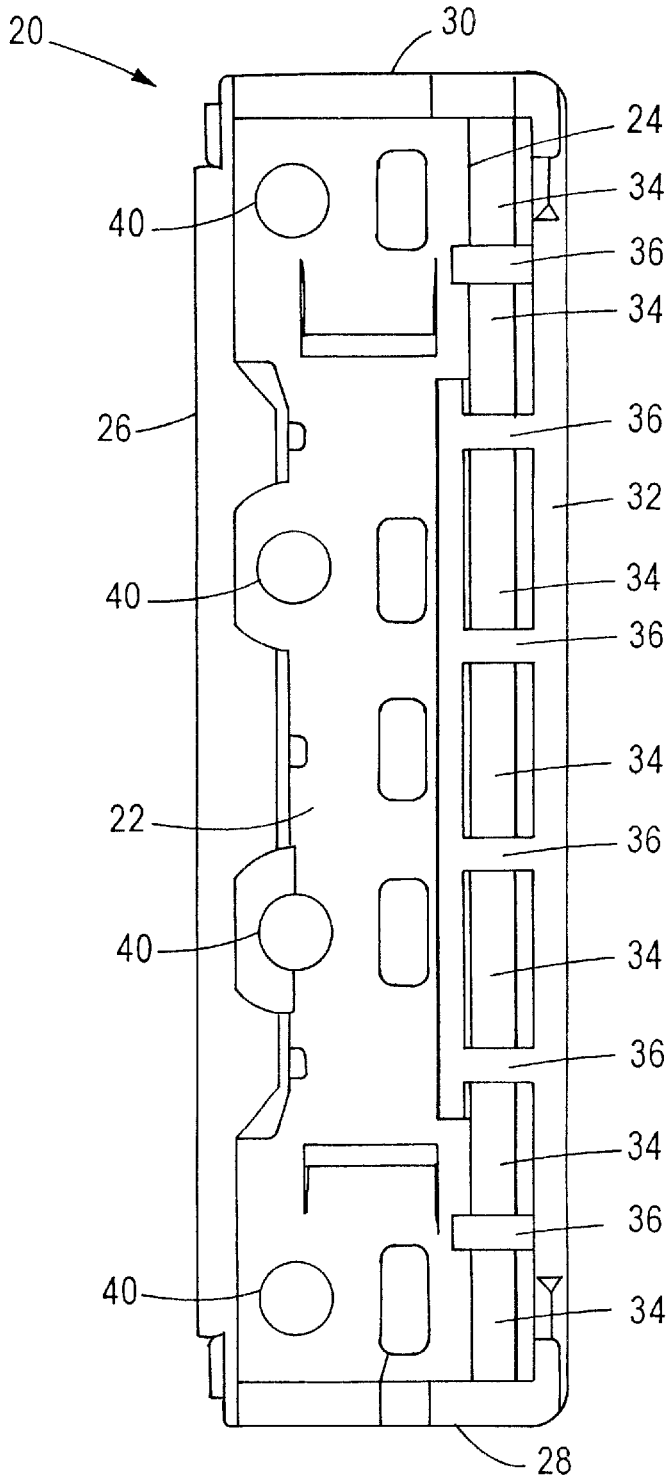
FIG. 2 illustrates a bottom plan view of an embodiment of a platform member of the present invention showing the blade seat, the guard member and a plurality of support members integrally molded to the blade seat and guard member.

As depicted in FIGS. 1 and 2, the platform member 20 includes a blade seat 22 having a front wall 24 and a rear wall 26, and ends 28, 30. The ends 28, 30 extend beyond the front wall 24 so as to allow a guard member 32 to be interconnected between the ends 28, 30 at a position forward of the front wall 24. The guard member 32 extends parallel to the front wall 24 forming a flow channel or slot 34 between the guard member 32 and the front wall 24. The guard member 32 also is connected to the front wall 24 by a plurality of support members 36, which extend substantially perpendicular to the longitudinal axis of the both the guard member 32 and the front wall 24.

The blade seat 22 includes an upper surface 38, as well as a plurality of securing apertures 40. The securing apertures 40 operate in conjunction with staking pins (or rivets) 102 located on the cap member 100 to permanently secure the platform member 20, the blades 50, 60, and 70, the spacer 80 and the cap member 100 together.

The blade cartridge 10 includes a primary or first blade 50, a secondary or second blade 60, and a tertiary or third blade 70, each having substantially parallel front and rear edges with the front edge of each blade defining a cutting edge 52, 62, and 72. Each blade 50, 60, and 70, defines a longitudinal axis that is parallel to the cutting edge of the blade 50, 60, and 70, and a lateral axis that is perpendicular to the cutting edge of the blade 50, 60, and 70.

Figure 3:
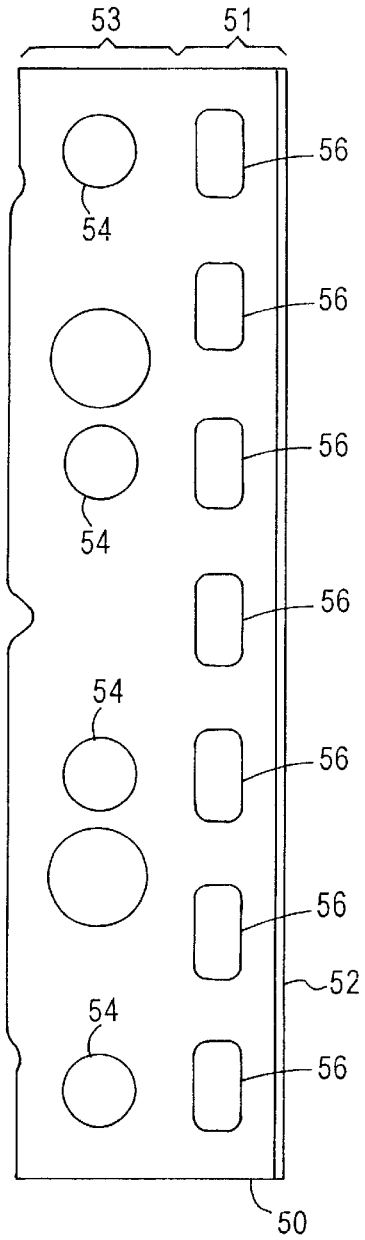
FIG. 3 illustrates a top plan view of a first blade of the present invention.

As depicted in FIG. 3, the first blade has a forward section 51 and a rearward section 53. The first blade 50 includes securing apertures 54 which align with the securing apertures 40 of the blade seat 22 so as to allow the staking pins 102 to pass through the securing apertures 54 of the first blade.50, thereby securing the first blade 50 to the blade cartridge 10. The rearward section 53 of the first blade 50 is fixed between the upper surface 38 of the blade seat 22 and the lower surface 84 of the spacer. A portion of the forward section 51 of the first blade 50 extends beyond the upper surface 38 of the blade seat 22. The first blade 50 also includes a plurality of apertures 56 arranged at the front portion of the first blade 50 near the cutting edge 52. The first blade includes a lower surface 58 and an upper surface 59, as depicted in FIG. 1.

As depicted in FIG. 1, the support members 36 extend downwardly away from the upper surface 38 of the blade seat 22 so as to create a gap 42 between the lower surface 58 of the first blade 50 and the upper surface 44 of each support member 36. The gap 42 allows for the passage of water and shaving debris beneath the first blade 50 and through the slot 34 between the guard member 32 and the front wall 24 to facilitate cleaning of the blade cartridge 10, as indicated by the dashed line and arrow Z—Z in FIG. 1 depicting a first debris flow path.

Figure 4:
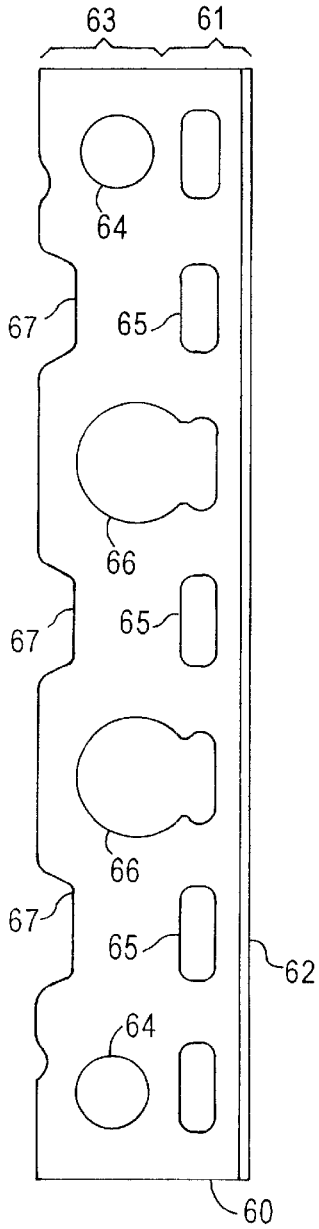
FIG. 4 illustrates a top plan view of a second blade of the present invention.

The second blade 60 is illustrated in FIG. 4. The second blade 60 has a forward section 61 and a rearward section 63. Similar to the first blade 50, the second blade 60 includes securing apertures 64 and 66 which align with the securing apertures 40 of the blade seat 22 so as to allow the staking pins 102 to pass through the securing apertures 64 and 66 of the second blade 60, thereby securing the blade to the blade cartridge 10. The rearward section 63 of the second blade 60 is fixed between the upper surface 82 of the spacer 80 and first portions 103 and 105 of the cap member 100. A portion of the forward section 61 of the second blade 60 extends beyond the upper surface 82 of the spacer 80. The second blade 60 also includes a plurality of apertures 65 arranged at the front portion of the second blade 60 near the cutting edge 62. The second blade includes a lower surface 68 and an upper surface 69, as depicted in FIG. 1.

As depicted in FIG. 1, an opening 46 is formed between the lower surface 68 of the second blade 60 and the upper surface 59 of the first blade 50. The opening 46 acts in conjunction with the plurality of apertures 56 arranged at the front portion of the first blade 50 and a plurality of apertures 21 in the platform member 20 to allow the passage of water and shaving debris through the blade cartridge 10 to facilitate cleaning thereof, as indicated by the dashed line and arrow Y—Y FIG. 1 depicting a second debris flow path.

Figure 5:
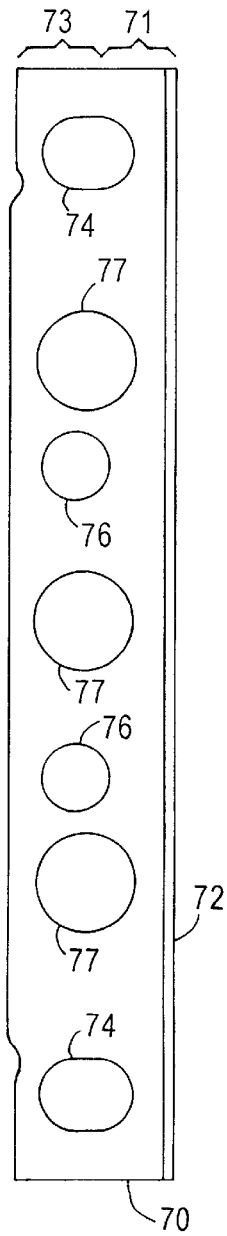
FIG. 5 illustrates a top plan view of a third blade of the present invention.

The third blade 60 is illustrated in FIG. 5. The third blade 70 has a forward section 71 and a rearward section 73. Similar to the first blade 50 and the second blade 60, the third blade 70 includes securing apertures 74 and 76 which align with the securing apertures 40 of the blade seat 22 so as to allow the staking pins 102 to pass through the securing apertures 74 and 76 of the third blade 70, thereby securing the blade to the blade cartridge 10. In the preferred embodiment of the present invention the forward section 71 of the third blade 70 proximate the cutting edge 72 thereof abuts a first protruding member 92 of the spacer 80. The rearward section 73 is fixed between a second protruding member 94 of the spacer 80 and the cap member 100. The third blade 70 also includes a plurality of holes or apertures 77. The third blade 70 has a lower surface 78 and an upper surface 79, as depicted in FIG. 1.

Figure 6:
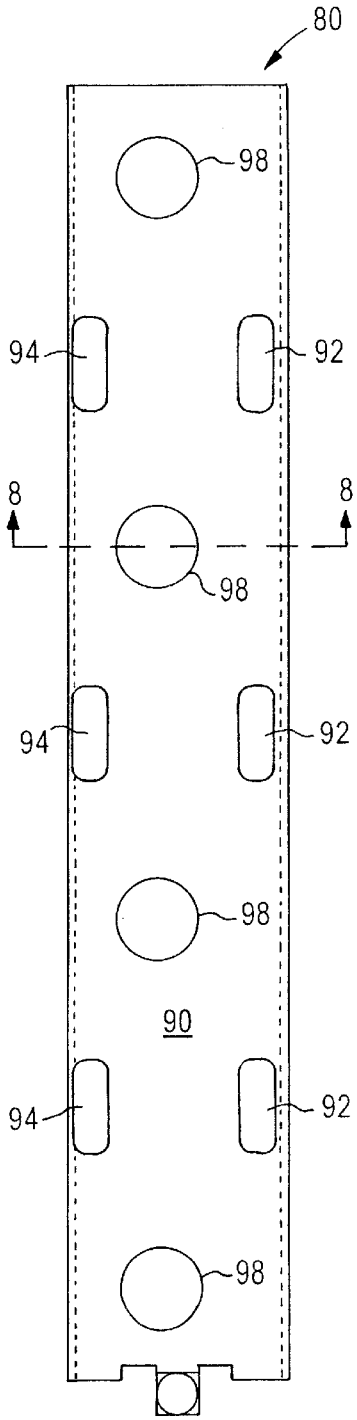
FIG. 6 illustrates a top plan view of an embodiment of a spacer of the present invention.
Figure 7:
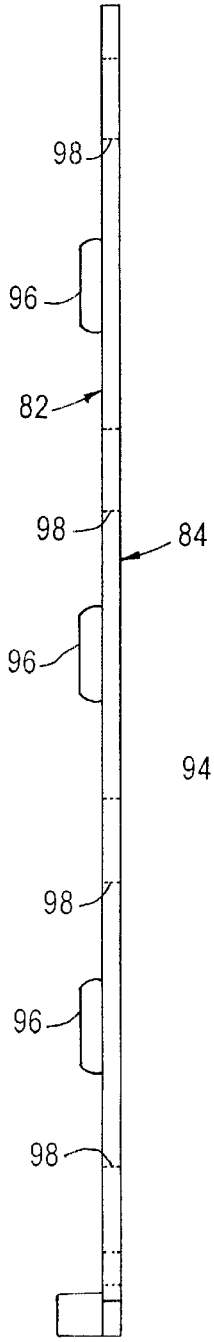
FIG. 7 illustrates a side view of the spacer depicted in FIG. 6.
Figure 8:
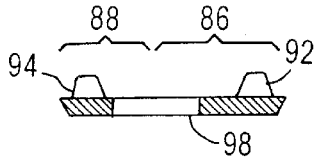
FIG. 8 illustrates an end view of the spacer depicted in FIG. 6 along line 8—8.

The spacer 80 functions to separate blades 50, 60, and 70. As depicted in FIGS. 6 through 8, the spacer 80 has an upper surface 82 and a lower surface 84, and is divided into a forward section 86 and a rear section 88. The spacer 80 includes a base portion 90 and a plurality of protruding members 92 and 94 extending from the upper surface 82 of the spacer 80. A first protruding member or first plurality of protruding members 92 is arranged along the forward section 86 of the spacer 80 and a second protruding member or second plurality of protruding members 94 is arranged along the rear section 88 of the spacer 80.

Figure 9:
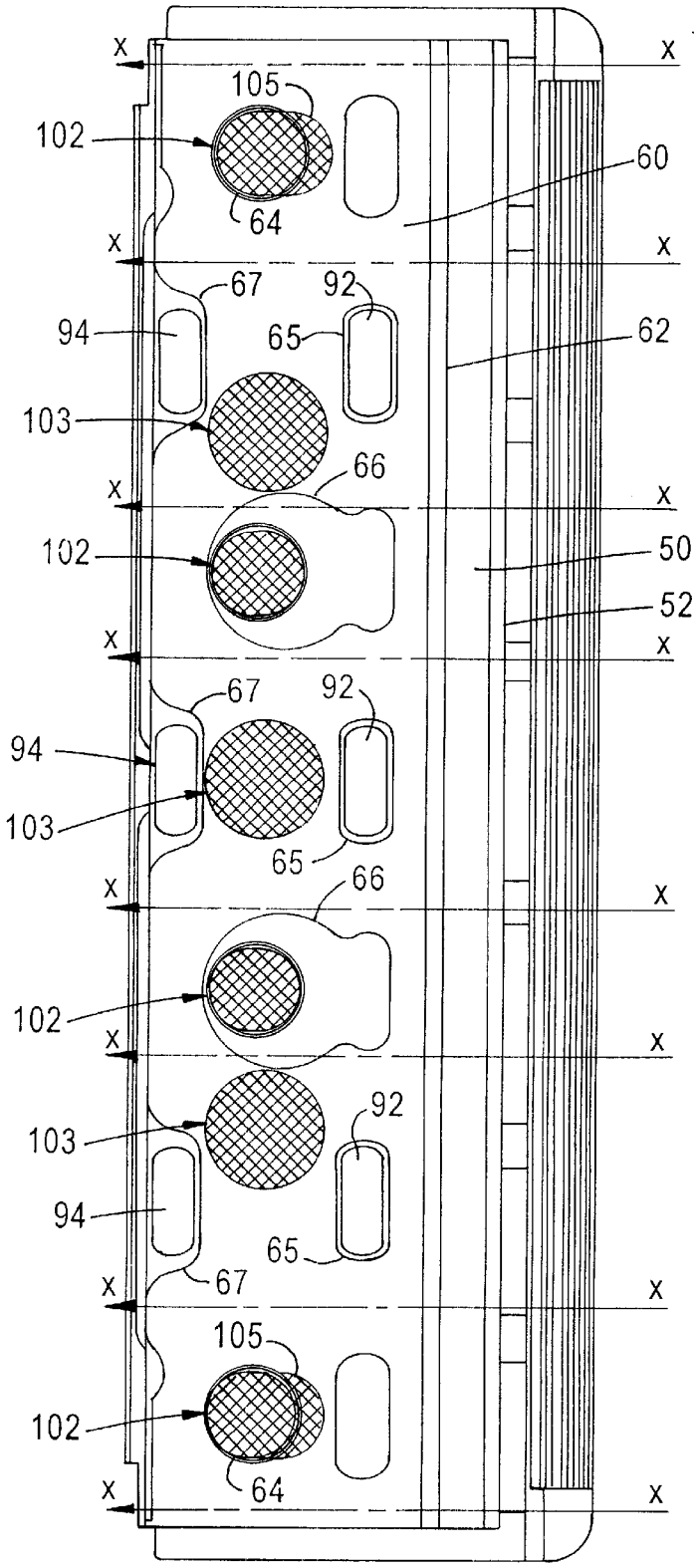
FIG. 9 illustrates a partial cross-sectional view of a blade cartridge of the present invention with the third blade and a portion of the cap member above the lower surface 104 thereof removed.

The lower surface 58 of the first blade 50 is disposed on the upper surface 38 of the blade seat 22. The lower surface 84 of the spacer 80 is disposed on the upper surface 59 of the first blade 50. The lower surface 68 of the second blade 60 is disposed on the upper surface 82 of the spacer 80. The first plurality of protruding members 92 extends through apertures 65 that are positioned near the cutting edge 62 of the second blade 60, as illustrated in FIG. 9. The second plurality of protruding members 94 is disposed within indentations 67 along a rearward edge of the second blade 60. The base portion 90 of the spacer 80 exhibits a uniform height so that when the blades 60 and 50 are secured to the upper surface 82 and lower surface 84 of the spacer 80, respectively, the blades 50 and 60 are parallel to one another.

The lower surface 78 of the third blade 70 is disposed on the upper surface 96 of the first and second plurality of protruding members 92 and 94. The first and second plurality of protruding members 92 and 94 exhibit a uniform height so that when the third blade 70 is secured to the upper surface 96 of the protruding members 92 and 94, the blades 50, 60, and 70 are parallel to one another. Preferably, the adjacent sides of the first blade 50 and the second blade 60 are separated from each other by a distance of about 0.020 inches by the spacer 80 and the second blade 60 and the third blade 70 are spaced apart from each other by a distance of about 0.020 inches. The cutting edges 52 and 62 are preferably spaced apart from each other by 0.024 inches and the cutting edges 62 and 72 are also preferably spaced apart from each other by 0.024 inches.

The lower surface 78 of the third blade 70 and the upper surface 69 of the second blade 60 and protruding members 92 and 94 of the spacer 80 define a flow channel or gap 48. The gap 48 allows the passage of water and shaving debris between the second blade 60 and third blade 70 to facilitate cleaning of the blade cartridge 10, as indicated by the dashed lines and arrows X—X in FIGS. 1 and 9 depicting a third debris flow path.

Furthermore, similar to the blades 50, 60, and 70, the spacer 80 comprises four securing apertures 98 that are located on the rear section 88 of the spacer 80. The securing apertures 98 operate in conjunction with the staking pins 102 to secure the spacer 80 to the blade cartridge 10.

FIG. 9 illustrates the alignment of the first blade 50, the second blade 60, and the spacer 80. As depicted the cutting edge 52 of the first blade 50 is located forward of the cutting edge 62 of the second blade 60 which is located forward of the cutting edge 72 of the third blade 70, as depicted in FIG. 1.

Figure 10:
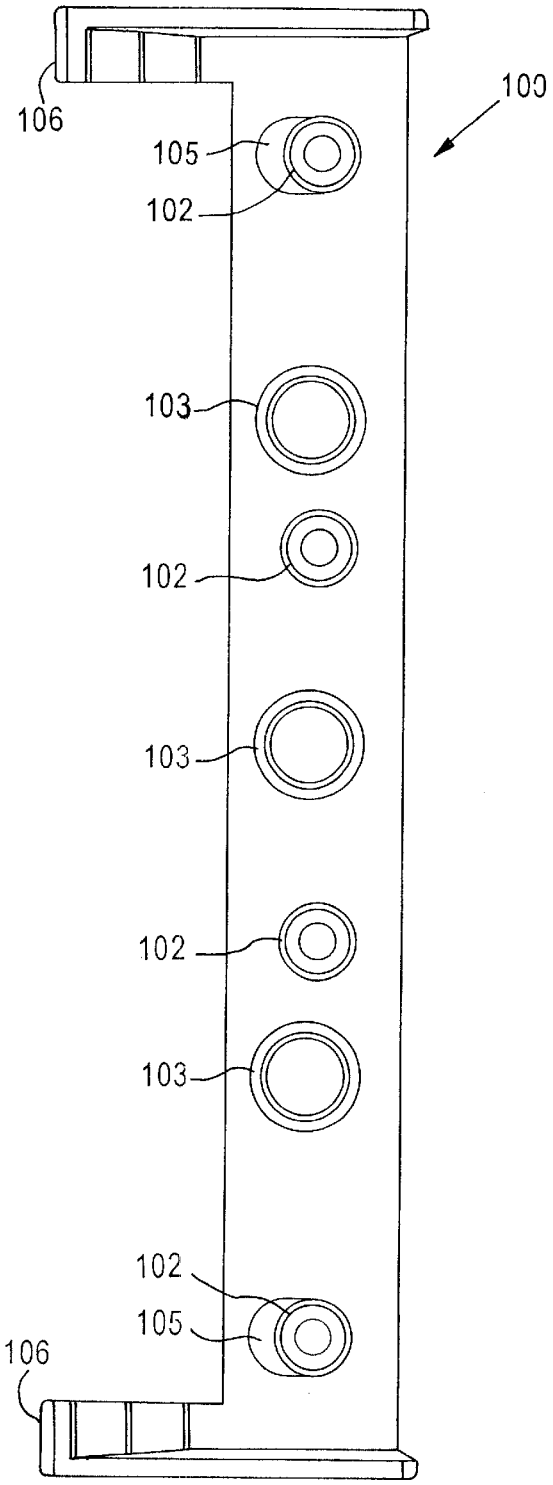
FIG. 10 illustrates a bottom plan view of an embodiment of a cap member blade of the present invention.
Figure 11:
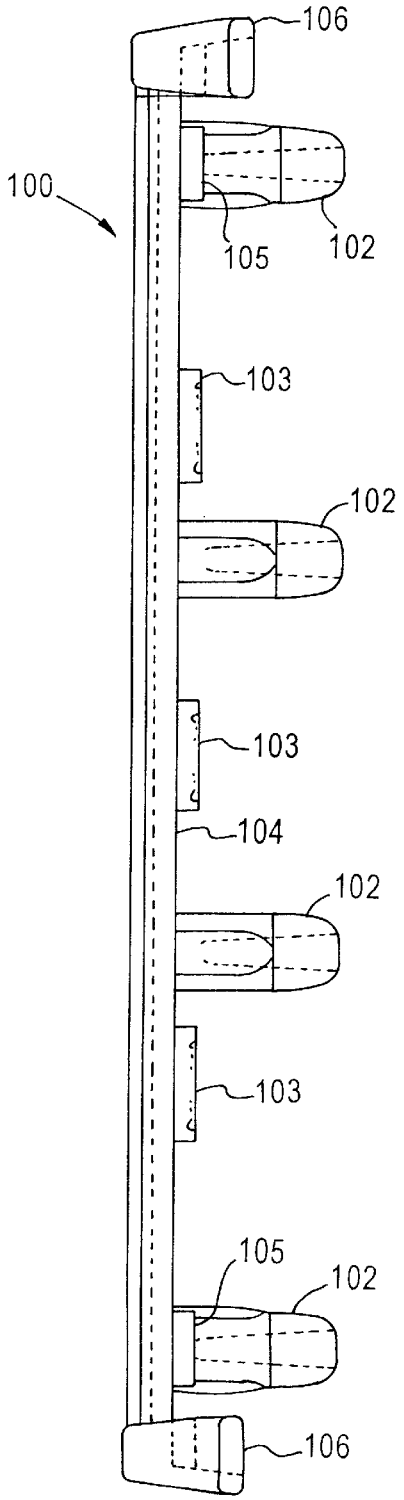
FIG. 11 illustrates a front view of the cap member depicted in FIG. 10.

An embodiment of the cap member 100 of the present invention is illustrated in FIGS. 10 and 11. A lower surface 104 of the cap member 100 is disposed on the upper surface 79 of the third blade 70. The cap member 100 includes a plurality of staking pins 102, such as rivets. Referring to FIG. 1, the staking pins 102 extend downwardly from the lower surface 104 of the cap member 100 and pass through the securing apertures 74 and 76 of the third blade 70, through the securing apertures 64 and 66 of the second blade, through the securing apertures 98 of the spacer 80, through the securing apertures 54 of the first blade 50, and into the securing apertures 40 of the blade seat 22. The ends of the staking pins 102 extend beyond the blade seat 22 and are upset thereby permanently affixing the blade seat 22, blades 50, 60, and 70, spacer 80, and cap member 100 together. The third blade 70 extends slightly beyond the lower surface 104 of the cap member 100, and therefore the cap member 100 operates as a stop limiting the upward movement of the third blade 70.

The cap member 100 includes a first portion that is disposed on the upper surface 69 of the second blade 60. A first embodiment of the first portion includes a boss or plurality of bosses 103 that extends downwardly from the lower surface 104 of the cap member 100. The plurality of bosses 103 extends through the plurality of holes 77 in the third blade 70 and is disposed on the upper surface 69 of the second blade 60.

The plurality of bosses 103 secures the second blade 60 within the blade cartridge 10, while allowing water and shaving debris from flowing through the gap 48 between the second blade 60 and the third blade 70.

A second embodiment of the first portion includes an elongated boss or plurality of elongated bosses 105 that extends downwardly from the lower surface 104 of the cap member 100 and is an integral part of the staking pins 102. The plurality of elongated bosses 105 extends through the plurality of securing apertures 74 in the third blade 70 and is disposed on the upper surface 69 of the second blade 60. The plurality of elongated bosses 105 secures the second blade 60 within the blade cartridge 10, while allowing water and shaving debris from flowing through the gap 48 between the second blade 60 and the third blade 70. The plurality of bosses 103 can be used in conjunction with the plurality of elongated bosses 105, as depicted in FIGS. 10 and 11, in order to ensures that the second blade 60 is securely held within the blade cartridge 10.

FIG. 1 illustrates in detail the novel structure of the blade cartridge 10 of the present invention. As is apparent, the first blade 50 is disposed on the upper surface 38 of the blade seat 22 with the cutting edge 52 extending over the slot 34 between the guard member 32 and the front wall 24 of the blade seat 22. The width of the blade seat 22 (i.e. the distance between the front wall 24 and rear wall 26) and the width of the first blade 50 are such that a portion of the first blade 50 extends over the slot 34.

The second blade 60 is disposed on the upper surface 82 of the spacer 80 with the cutting edge 62 extending over the opening 46 created between the first blade 50 and the second blade 60. Similar to the first blade 50, the width of the spacer 80 and the width of the second blade 60 are such that a portion of the second blade 60 extends over the opening 46.

In order to prevent the corners of the blades 50, 60, and 70 from engaging the skin of the user, end caps 106 cover the outer edges of the first, second, and third blades 50, 60, and 70. As depicted in FIGS. 10 and 11, each end cap 106 is located at the ends of the cap member 100. The end caps 106 are either integrally molded with the cap member 100 or they are separate pieces affixed to the cap member 100.

As a result of mounting the blades 50, 60, and 70 in accordance with the present invention, there is no longitudinal movement of any of the blades 50, 60, and 70 relative to the remainder of the blade cartridge 10.

As illustrated in FIG. 1, the guard member 32 placed in front of the first blade 50 is integral with the ends 28, 30 of the platform member 20 and is therefore stationary relative to the blade cartridge 10. The guard 32 being positioned in front of the first blade 50 has a raised skin engaging portion 33, which provides an engaging surface to control exposure of the first blade 50 to the shaver's skin.

In another variation, the guard member 32 may include means to allow independent movement of the guard member 32 in the direction away from the direction of shaving forces acting upon the guard member 32. Jacobson U.S. Pat. Nos. 4,442,598, 4,378,634 and 4,270,268 disclose a blade cartridge having movable guard means.

Similarly, the cap member 100 may include means to allow independent movement in a direction away from the direction of shaving forces acting upon the cap member 100. Oldroyd et al., U.S. Pat. No. 4,063,354, discloses a shaving unit having a movable cap member 100 suitable for use with this invention.

In yet another variation, a shaving aid or lubrication applicator 110 may be affixed or included with the blade cartridge 10. Typically, as depicted in FIG. 1, the shaving aid 110 comprises a polystyrene-polyethylene oxide blend in the form of lubricating strip 112, which may affixed to the upper surface 108 of the cap member 100 behind the third blade 70. During shaving, the polyethylene oxide bleaches out of the styrene matrix. The cap member 100 may have a molded lube strip 112 glued on or the lube strip 112 may be molded onto the cap member 100 in a second shot. Other suitable shaving aids for use with the invention are also described in U.S. Pat. No. 4,170,821 issued to Booth entitled "Razor Cartridges." Preferably, the shaving aid 110 comprises a matrix of polystyrene, polyethylene oxide and aloe and/or vitamin E.

In yet a further variation, the blade cartridge 10 may be permanently or detachably connected to a handle by suitable structures formed on the bottom surface of the blade cartridge 10. It is within the spirit of this invention to detachably connect the blade cartridge 10 to a handle, such as in U.S. Pat. No. 4,026,016 entitled RAZOR BLADE ASSEMBLY, issued to Warren I. Nissen, which is incorporated herein by reference. Alternatively, the blade cartridge 10 can be mounted on a handle in such a manner that it is stationary while it is used to shave a surface.

The first and second plurality of protruding members 92 and 94 create a gap defined by the second blade 60 and the third blade 70 to allow water and any shaving debris to be led out the back of the blade cartridge 10. Conversely, water can be directed into the back of the blade cartridge 10 to be channeled out through the front of the blade cartridge 10 and over the edges 62 and 72 of the blades 60 and 70. A similar effect is achieved when water is directed through opening 46 and slot 34.

Another embodiment of the present invention can be constructed that includes four or more blades that are spaced apart by a single spacer. Such embodiments can be achieved by forming a spacer having protruding members of various lengths. The first protruding member extends through an aperture in the second blade, that is disposed on the upper surface of the spacer, and a third blade is disposed on the upper surface of the first protruding member, as is described for the preferred embodiment above. A second protruding member extends through an aperture in the second blade, through an aperture in the third blade, and a fourth blade is disposed on the upper surface of the second protruding member. Theoretically, an infinite number of protruding members can be used to space apart an infinite number of blades using the teachings of the present invention.

The embodiments described above provide a number of significant advantages. The present invention provides a blade cartridge arrangement and spacer that secures and spaces multiple blades in a manner that allows water and shaving debris to be easily flushed out of the blade cartridge.

Of course, it should be understood that a wide range of changes and modifications could be made to the preferred embodiment described above. It is therefore intended that the present invention is not limited to the embodiments described above, but encompasses any and all embodiments within the scope of the following claims, and equivalents thereof.

What is claimed is:

1. A razor cartridge comprising:

a platform member;

a first blade placed on said platform member;

a spacer having a base portion with an upper surface and a lower surface;

a second blade; and a third blade, wherein said base portion of said spacer is positioned between said first blade and said second blade such that said lower surface is disposed on said first blade and said upper surface supports said second blade, said spacer having at least one protrusion member extending above said upper surface supporting said third blade, said spacer being in a fixed relationship to said platform member.

2. The invention of claim 1, wherein said first, second, and third blades together with said spacer are secured to said platform member by a cap.

3. The invention of claim 2, wherein said first blade together with said platform member define a first debris flow path.

4. The invention of claim 2, wherein said first blade, said second blade, and said platform member define a second debris flow path.

5. The invention of claim 2, wherein said second blade, said third blade and said spacer define a third debris flow path.

6. The invention of claim 1, wherein said first blade together with said platform member define a first debris flow path.

7. The invention of claim 1, wherein said first blade, said second blade, and said platform member define a second debris flow path.

8. The invention of claim 1, wherein said second blade, said third blade and said spacer define a third debris flow path.

9. The invention of claim 1, wherein said first blade together with said platform member define a first debris flow path; said first blade, said second blade, and said platform member define a second debris flow path; and said second blade, said third blade, and said spacer define a third debris flow path.

10. The invention of claim 1 wherein said spacer has a forward section and a rearward section, said upper surface of said forward section having a first plurality of members protruding therefrom, and said upper surface of said rearward section having a second plurality of members protruding therefrom.

11. A blade cartridge comprising:

a platform member having a blade seat and a guard member, said blade seat having an upper surface;

a first blade having an upper and lower surface and a cutting edge, said first blade disposed on said upper surface of said blade seat such that said cutting edge is located rearwardly of said guard member;

a spacer having an upper and a lower surface, said lower surface of said spacer disposed on said upper surface of said first blade, said spacer having a member protruding from said upper surface of said spacer;

a second blade having an upper and a lower surface, said lower surface of said second blade disposed on said upper surface of said spacer, said second blade having a cutting edge located rearwardly of said cutting edge of said first blade;

a third blade having an upper and a lower surface, said lower surface of said third blade disposed on said protruding member of said spacer, said third blade having a cutting edge located rearwardly of said cutting edge of said second blade; and a cap member disposed on said upper surface of said third blade, said cap member secured to said first, second, and third blades, said spacer, and said platform member, wherein said spacer is in a fixed relationship with said platform member.

12. The blade cartridge according to claim 11 wherein:

said first blade has an aperture; and said spacer is disposed on said first blade such that a portion of said aperture is unobstructed.

13. The blade cartridge according to claim 11 wherein:

said second blade has an aperture; and said protruding member of said spacer extends through said aperture in said second blade.

14. The blade cartridge according to claim 11 wherein said cap member includes a first portion disposed on said upper surface of said second blade.

15. The blade cartridge according to claim 11 further comprising a lubrication applicator disposed on said cap member.

16. The blade cartridge according to claim 11 wherein said first blade has a forward section and a rearward section, said rearward section being fixed between said upper surface of said blade seat and said lower surface of said spacer.

17. The blade cartridge according to claim 16 wherein a portion of said forward section of said first blade extends beyond said upper surface of said blade seat.

18. The blade cartridge according to claim 11 wherein said second blade has a forward section and a rearward section, said rearward section being fixed between said upper surface of said spacer and said first portion of said cap member.

19. The blade cartridge according to claim 18 wherein a portion of said forward section of said second blade extends beyond said upper surface of said spacer.

20. The blade cartridge according to claim 11 wherein:

said protruding member of said spacer includes a first protruding member; and said third blade has a forward section proximate said cutting edge thereof that abuts said first protruding member of said spacer.

21. The blade cartridge according to claim 20 wherein:

said protruding member of said spacer includes a second protruding member; and said third blade has a rearward section that is fixed between said second protruding member and said cap member.

22. The blade cartridge according to claim 11 wherein said guard member is disposed forward of said blade seat so as to form a slot between said blade seat and said guard member.

23. The blade cartridge according to claim 11 wherein said lower surface of said third blade and said upper surface of said second blade define a gap.

24. The blade cartridge according to claim 23 wherein:

said first blade has an aperture; and said spacer is disposed on said first blade such that a portion of said aperture is unobstructed.

25. The blade cartridge according to claim 24 wherein said guard member is disposed forward of said blade seat so as to form a slot between said blade seat and said guard member.

26. A blade cartridge comprising:

a platform member having a blade seat and a guard member, said blade seat having an upper surface;

a first blade having an upper and lower surface and a cutting edge, said first blade disposed on said upper surface of said blade seat such that said cutting edge is located rearwardly of said guard member;

a spacer having an upper and a lower surface, said lower surface of said spacer disposed on said upper surface of said first blade, said spacer having a member protruding from said upper surface of said spacer;

a second blade having an upper and a lower surface, said lower surface of said second blade disposed on said upper surface of said spacer, said second blade having a cutting edge located rearwardly of said cutting edge of said first blade;

a third blade having an upper and a lower surface, said lower surface of said third blade disposed on said protruding member of said spacer, said third blade having a cutting edge located rearwardly of said cutting edge of said second blade; and a cap member disposed on said upper surface of said third blade, said cap member secured to said first, second, and third blades, said spacer, and said platform member, wherein said cap member includes a first portion disposed on said upper surface of said second blade, and wherein said third blade has an aperture, said first portion of said cap member extending through said aperture in said third blade.

27. A blade cartridge comprising:

a platform member having a blade seat and a guard member, said blade seat having an upper surface;

a first blade having an upper and lower surface and a cutting edge, said first blade disposed on said upper surface of said blade seat such that said cutting edge is located rearwardly of said guard member;

a spacer having an upper and a lower surface, said lower surface of said spacer disposed on said upper surface of said first blade, said spacer having a member protruding from said upper surface of said spacer;

a second blade having an upper and a lower surface, said lower surface of said second blade disposed on said upper surface of said spacer, said second blade having a cutting edge located rearwardly of said cutting edge of said first blade;

a third blade having an upper and a lower surface, said lower surface of said third blade disposed on said protruding member of said spacer, said third blade having a cutting edge located rearwardly of said cutting edge of said second blade; and a cap member disposed on said upper surface of said third blade, said cap member secured to said first, second, and third blades, said spacer, and said platform member, wherein said spacer has a forward section and a rearward section, said upper surface of said forward section having a first plurality of members protruding therefrom, and said upper surface of said rearward section having a second plurality of members protruding therefrom.

28. A blade cartridge comprising:

a platform member having a blade seat and a guard member, said blade seat having an upper surface;

a first blade having an upper and lower surface and a cutting edge, said first blade disposed on said upper surface of said blade seat such that said cutting edge is located rearwardly of said guard member;

a spacer having an upper and a lower surface, said lower surface of said spacer disposed on said upper surface of said first blade, said spacer having a member protruding from said upper surface of said spacer;

a second blade having an upper and a lower surface, said lower surface of said second blade disposed on said upper surface of said spacer, said second blade having a cutting edge located rearwardly of said cutting edge of said first blade;

a third blade having an upper and a lower surface, said lower surface of said third blade disposed on said protruding member of said spacer, said third blade having a cutting edge located rearwardly of said cutting edge of said second blade; and a cap member disposed on said upper surface of said third blade, said cap member secured to said first, second, and third blades, said spacer, and said platform member, wherein said cap member includes a staking pin extending through a securing aperture in said third blade, through a securing aperture in said second blade, through a securing aperture in said spacer, through a securing aperture in said first blade, and through a securing aperture in said platform member.

29. The blade cartridge according to claim 28 wherein said staking pin includes a first portion disposed on said upper surface of said second blade.

30. The blade cartridge according to claim 29 wherein said third blade has an aperture, said first portion of said staking pin extending through said aperture in said third blade.

* * * * *